US007023340B2

(12) United States Patent
Egli et al.

(10) Patent No.: US 7,023,340 B2
(45) Date of Patent: Apr. 4, 2006

(54) TAMPER RESISTANT COVER AND USE THEREOF

(76) Inventors: Peter Egli, Rue de Lausanne 64, Morges (CH) CH-110; Roland Cochard, Avenue Alfred Andre 7, Morges (CH) CH-110

( * ) Notice: Subject to any disclaimer, the term of this patent is extended or adjusted under 35 U.S.C. 154(b) by 116 days.

(21) Appl. No.: 10/492,363

(22) PCT Filed: Oct. 13, 2001

(86) PCT No.: PCT/EP01/11853

§ 371 (c)(1),
(2), (4) Date: Apr. 13, 2004

(87) PCT Pub. No.: WO03/033373

PCT Pub. Date: Apr. 24, 2003

(65) Prior Publication Data

US 2004/0245205 A1 Dec. 9, 2004

(51) Int. Cl.
*G08B 13/08* (2006.01)

(52) U.S. Cl. ..... 340/545.6; 340/541; 340/568.1; 340/572.9; 340/5.51

(58) Field of Classification Search ..... None
See application file for complete search history.

(56) References Cited

U.S. PATENT DOCUMENTS 4,483,449 A 11/1984 Jones
4,845,470 A 7/1989 Boldt
5,328,597 A * 7/1994 Boldt et al. ..... 210/87
6,209,592 B1 * 4/2001 Gilboa et al. ..... 141/94
6,239,712 B1 * 5/2001 Hawk ..... 340/686.1
6,271,753 B1 * 8/2001 Shukla ..... 340/545.6
6,515,574 B1 * 2/2003 Herbert et al. ..... 340/5.3
6,545,594 B1 * 4/2003 Knight et al. ..... 340/384.7
6,879,876 B1 * 4/2005 O'Dougherty et al. ..... 700/231

FOREIGN PATENT DOCUMENTS

| | | |
|---|---|---|
| DE | 100 59 539 | 9/2001 |
| EP | 0 269 317 | 6/1988 |
| FR | 2 767 515 | 2/1999 |
| WO | WO 99/65785 | 12/1999 |

* cited by examiner

*Primary Examiner*—Daniel Wu
*Assistant Examiner*—Son Tang
(74) *Attorney, Agent, or Firm*—Young & Thompson

(57) ABSTRACT

A membrane for a cover for closing a container having the general form of a cylinder and being compressible in the direction of the axis of the cylinder. The membrane comprises two mutually parallel, generally flat parts arranged to move axially in relation to each other guided in the movement by guiding elements; resilient element arranged to generate a counterforce between the flat parts during compression of the membrane in the direction of the axis; at least a first and a second electrical contact device operated by the axial movement between the circular parts, the combined electrical settings of which contact devices will carry information about the compressions and decompressions of the membrane and elements for presenting the settings to the outside of the membrane. A cover comprising such a membrane and use thereof are also described.

12 Claims, 12 Drawing Sheets

TAMPER RESISTANT COVER AND USE THEREOF

TECHNICAL FIELD

A first aspect of the present invention concerns a membrane for a cover for closing a container. Such a container could e.g. be an ordinary bottle provided with a screwed-on cap for closing the same. The container could however have many other forms and the closure does not have to be arranged to be screwed-on at the closing. Bottles, especially bottles for liquid, usually have a membrane arranged inside to give the liquid tight closing of the bottle. The function of the membrane could, however, be integrated in the cap itself.

Another aspect of the invention concerns an anti-fraud system for an installation for automatic distribution of a product and a method for protection of the distribution and use of a product against fraud which system and method are making use of containers provided with membranes or covers according to the above.

The products transported and stored in the containers could be of any type but typically the invention will be used when transporting, storing and making use of valuable products, dangerous products etc., i.e. in applications in which it is of interest to be able to confirm the authenticity of the product at the user end. The end-user would e.g. like to know that the price he is paying is for a proven authentic product. The product could also be e.g. a sensitive medical product. The field of use could e.g. comprise a process making use of a product the substitution of which would create a great danger. In such a case it would of CONFIRMATION COPY course be valuable to be able to confirm the authenticity of the product before it is used in the process. The invention could also be used for safe transport and storing of e.g. documents, software etc.

The invention will give the possibility to indicate if a container, especially the closure of the container has been tampered with during transport and storing.

BACKGROUND ART

There exist in the prior art a number of different approaches for producing a tamper resistant package. The level of sophistication depends on the expected security. For lower security needs containers whose covers are essentially mechanically sealed through the use of a ratchet mechanism have been proposed.

For higher security needs it has been proposed a tamper indicating active device for a container and closure therefor, comprising display means to display a signal indicative of the state of the closure.

As one example of many of an application in which it would be extremely important to control the complete link between the product producer and the use of the product the disinfecting of public air-conditioning systems could be mentioned.

BRIEF DESCRIPTION OF THE INVENTION

It is an object of the present invention to provide a membrane for a cover for closing a container which indicates whether the container or package has been tampered with and which does not need any active energy storing element for its operation.

It is a further object of the invention to provide an anti-fraud system for an installation for automatic distribution of a product.

It is a still further object of the invention to provide a method for protection of the distribution and use of a product against fraud.

The invention is characterised according to the enclosed claims.

BRIEF DESCRIPTION OF THE FIGURES

Other objects, uses and advantages of this invention will be apparent from the reading of this description which proceeds with reference to the accompanying drawings forming part thereof and wherein.

DETAILED DESCRIPTION OF THE INVENTION

In the following an embodiment of the invention in the form of a separate insert or membrane for a cover or cap for closing a bottle or more generally a container will be described. It is clear that the features of this membrane as an alternative could be integrated into the cap or cover. The advantage of including all the necessary functions in a separate membrane is that practically any container with its originally designed cover could be prepared for use in the method according to the invention by simply substituting the original membrane against a membrane according to the invention.

Figure 1:
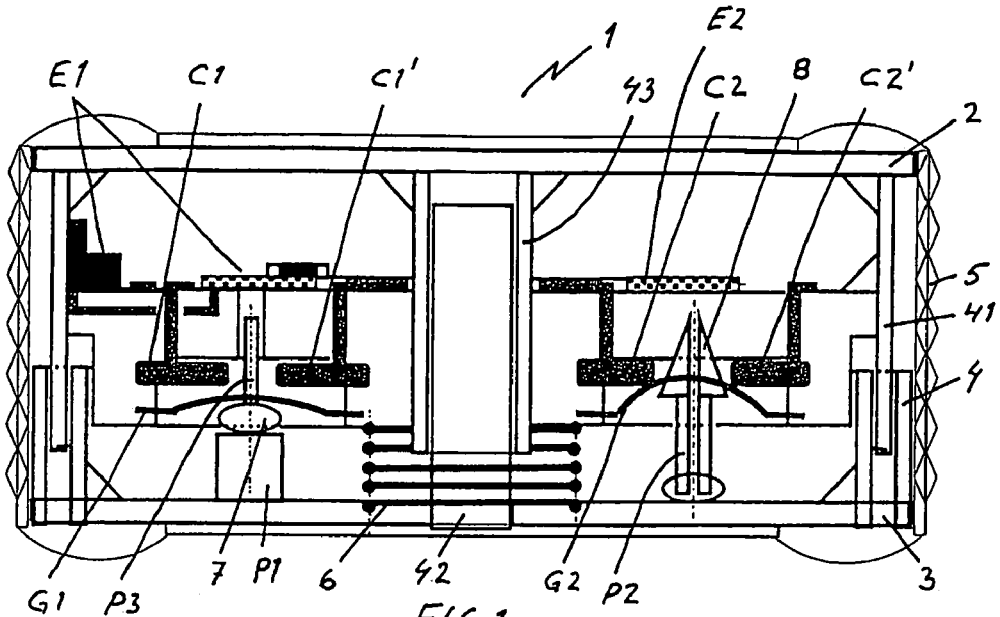
FIG. 1 shows in section the essential parts of a membrane according to the invention, FIGS. 2 *a* and *b* show the electromechanical contacts of the membrane in their respective positions before the first closing of the cover, FIGS. 3 *a* and *b* show the electromechanical contacts of the membrane in their respective positions after the first closing of the cover, FIGS. 4 *a* and *b* show the electromechanical contacts of the membrane in their respective positions after the first opening of the cover, FIGS. 5 *a* and *b* show the electromechanical contacts of the membrane in their respective positions after the second closing of the cover.

FIG. 1 shows in section the essential parts of a membrane according to the invention.

The unit generally designated 1 is in the following called a membrane. It can have the size and look of an ordinary insert in e.g. a cap for closing a bottle, i.e. a relatively thin and flat circular cylinder. In order to close and seal the bottle such an insert should preferably have a soft surface structure and be somewhat compressible in the direction of the axis of the cylinder. The membrane 1 has these features too. A thin layer 5 of rubber or rubber-like material is covering the cylinder in the shown example. Therefore the physical sealing of the bottle or more general, container, is guaranteed.

Now, this membrane or insert differs from ordinary inserts in the following way. Two mutually parallel, generally flat and circular parts 2 and 3 are arranged at the upper and lower part of the membrane respectively. These two parts can move axially in relation to each other and are guided in that movement by means of guiding means 4, 41, 42 and 43. Other types of guiding means could of course be envisaged for the same purpose. Resilient means, here shown as a spring 6, are arranged to give the flexible features for the membrane during compression in the direction of the axis. This spring 6 together with the circular parts 2 and 3 and the guiding means 4, 41, 42 and 43 also contributes to the definition of the starting position of the contact devices described below.

Additionally, the interior of the membrane comprises two electromechanical contact devices G1, C1, C1' and G2, C2, C2' respectively. The two contact devices are operated by means of the axial movement between the circular parts 2 and 3. There are, however, essential differences in the operation of the two contact devices. A more detailed description of these devices will follow below with reference to the drawings 2, 3, 4 and 5.

As will be described below the settings of these contact devices will carry information about the manipulation of the cover of the container. It is therefore of interest, especially at the end-user side to be able to detect said settings. In a simple embodiment of the membrane the detection could be made with galvanic means. Another possibility would be to detect the settings by means of capacitive measurements. Still further detection methods could be envisaged. Membranes of this basic structure could e.g. be used in applications in which a simple and cheap but efficient way of detection of the manipulation is desired.

In a more complex embodiment various electronic circuits are also comprised in the membrane, generally designated E1 and E2 in FIG. 1. In the shown embodiment the energy for the operation of these electronic circuits is transmitted from the outside as will be described in the following. The circuits comprise essentially an antenna with associated RF circuitry, control logic circuits and a memory. As a whole such a unit is usually referred to as a transponder/sensor. It should be emphasised that the invention does not concern a transponder/sensor as such. Transponder/sensors of this type as well as co-operating transceivers for energy and data transmission are known in the art.

It is clear that certain dimensions of the membrane have been exaggerated in this figure in order to better illustrate the different parts and functions of the same.

Figure 2:
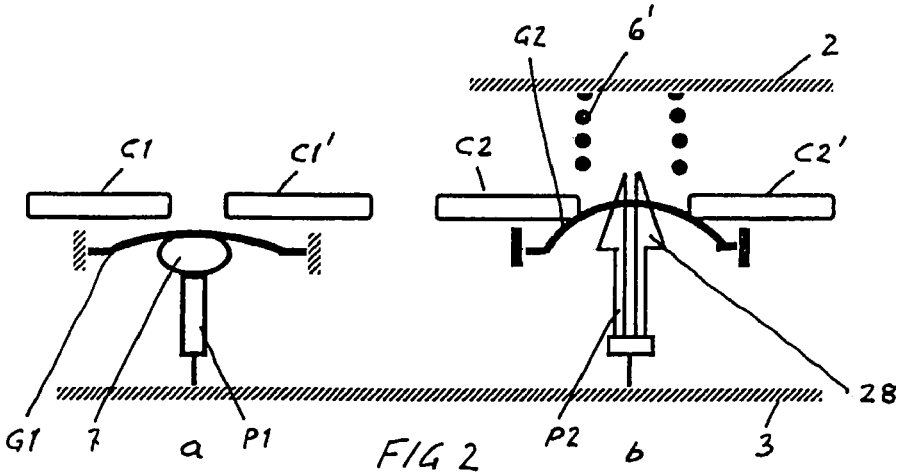

FIGS. 2 *a* and *b* show the electromechanical contact devices of the membrane in their respective positions before the first closing of the cover. Take note that other embodiments of the contacts devices can be envisaged.

At least two contact devices are needed in the membrane to give the desired function. The contact devices according to the shown embodiment have in common that they are operated by the axial compression and expansion of the membrane insert 1 which are due to the closing and opening of the associated container respectively.

Each such contact device comprises two contact elements C1, C1' and C2, C2' respectively arranged with a gap in between. This gap could be mechanically and electrically bridged by means of a thin prestressed metallic part G1 and G2 respectively. In the embodiment according to FIG. 2*a* an operating head 7 in contact with the prestressed metallic part G1 is mechanically connected to the circular part 3 at the lower part of the membrane, cf. FIG. 1, on a fixed distance from the same defined by means of the distance element P1. The contact elements C1, C1' and the metallic part G1 are arranged mechanically fixed to the circular part 2 at the upper part of the membrane, as can be seen in FIG. 1.

Thus, when the membrane is compressed during the closing of a container and the circular parts 2 and 3 are approaching each other the prestressed metallic part G1 will obviously be pressed upwards by the operating head 7 into contact with the contact elements C1, C1', cf. FIG. 3*a*.

In FIG. 2*b* the second contact device of the membrane is illustrated. The resilient feature of the membrane is schematically shown my means of a spring 6'. In reality the implementation of this feature could have the form as shown in FIG. 1.

The prestressed metallic part G2 is already before the first compression of the membrane in contact with the contact elements C2, C2'. The operating head 8 is partly reaching through a hole in the metallic part G2. In the illustrated example the head has the form of an arrow provided with a longitudinal slit in order to give lateral flexibility and two barbs 28. Other designs of the head 8 can be envisaged. It could for instance be sufficient with one barb.

Thus, during the first compression of the membrane the operating head 8 will contract and penetrate through the hole in the metallic part G2 and again expand laterally after full penetration, cf. FIG. 3*b*. The barb 28 is now locking against the upper side of the metallic part G2.

Figure 3:
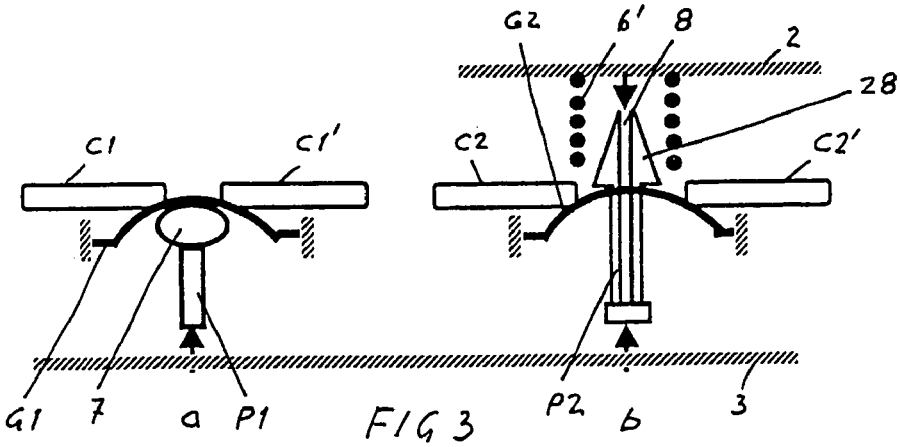

FIG. 3 *a* and *b* thus show the electromechanical contact devices of the membrane in their respective positions after the first closing of the cover. The membrane is kept compressed by the closing forces between the container and the cover.

Figure 4:
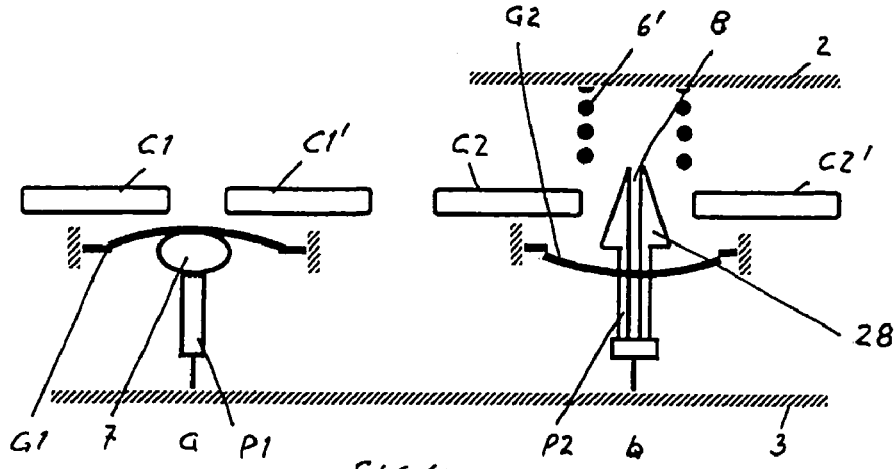

FIG. 4 *a* and *b* show the electromechanical contact devices of the membrane in their respective positions after the first opening of the cover.

If the container is now opened by e.g. unscrewing the cover the axial pressure on the membrane will be released and the membrane will expand. From the above description it is clear that the contact device C1, C1', G1 will now open, cf. FIG. 4 *a*.

Due to the barbs 28 of the operating head 8 the prestressed metallic part G2 will be pulled downwards which opens the contact C2, C2', G2. The vertically expanding movement of the membrane will continue until it reaches a point at which the prestressed metallic part G2 snaps into its second bistable position as shown in FIG. 4 *b*.

Figure 5:
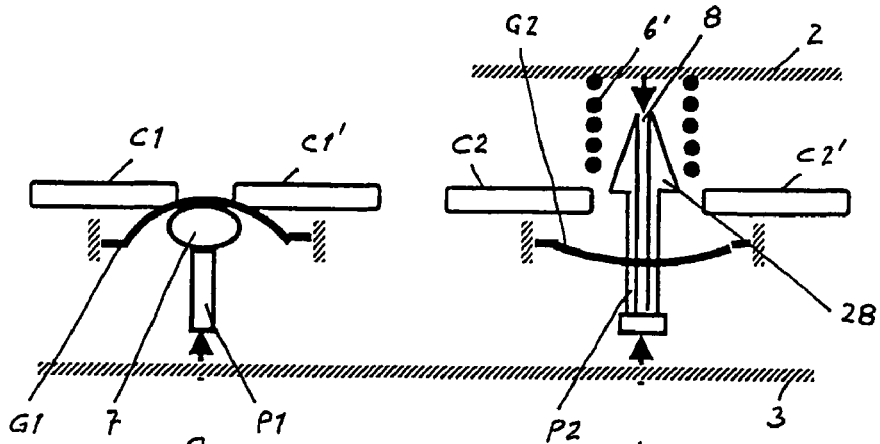

FIGS. 5 *a* and *b* show the electromechanical contact devices of the membrane in their respective positions after the second and subsequent closings of the cover.

If the container is now closed again by means of the cover the contact device C1, C1', G1 will again close as shown in FIG. 5 *a*. On the other hand the contact device C2, C2', G2 will remain open because the compressing axial forces on the membrane will not be transferred to the prestressed metallic part G2. The distance element P2 is just sliding in the hole in the prestressed metallic part G2.

Thus, during any subsequent opening and closing of the container only the contact device C1, C', G1 will change its state while the contact device C2, C2', G2 will constitute a simple memory device storing information concerning the first opening of the container. It is once again noted that this memory function can also be implemented in other ways.

Figure 6:
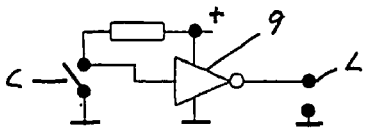
FIG. 6 shows in a schematic form an electronic circuit for creating a logical output signal representing the position of one of the electromechanical contacts of the membrane.

FIG. 6 shows in a schematic form an example of a simple electronic circuit for creating a logical output signal with values 1 or 0 representing the position of one of the electromechanical contact devices of the membrane. The contact device is generally designated C. It has according to the above only two positions, ON or OFF. An inverter 9 gives on its output terminal a logical signal L which could be low (=0) or high (=1). When the contact device C is closed the output signal L obviously equals 1 and when C is open the signal L equals 0.

Figure 7:
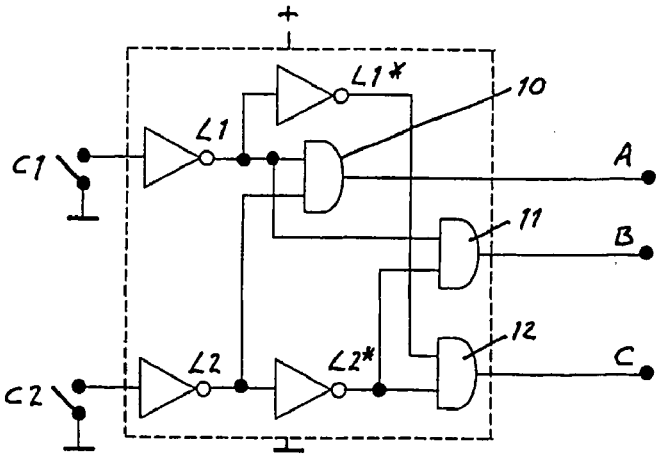
FIG. 7 shows in a schematic form an electronic circuit for creating a three bit control word representing the positions of the two electromechanical contacts of the membrane

FIG. 7 shows in a schematic form an electronic circuit for creating a three bit logical data word representing the positions of the two electromechanical contact devices of the membrane. By means of a number of logical inverters and co-operating AND gates 10, 11, 12, a three bit word A, B, C can be created. This word on the output from the circuit according to FIG. 7 is sent to the data processing and memory control circuits of the membrane. The first and the second contact device of the membrane are designated C1 and C2 respectively.

The corresponding logical output signals are designated L1 and L2. The inverse of these signals have been designated L1* and L2* respectively. The operation of the circuit is described in the following table 1.

TABLE 1

| L1 | L1* | L2 | L2* | A = L1 & L2 | B = L1 & L2* | C = L1* & L2* | STATE OF MEMBRANE |
|---|---|---|---|---|---|---|---|
| 0 | 1 | 1 | 0 | 0 | 0 | 0 | STATE 1 |
| 1 | 0 | 1 | 0 | 1 | 0 | 0 | STATE 2 |
| 0 | 1 | 0 | 1 | 0 | 0 | 1 | STATE 3 |
| 1 | 0 | 0 | 1 | 0 | 1 | 0 | STATE 4 |

STATE 1 = Initial state of the membrane as illustrated in FIG. 2.
STATE 2 = This state of the membrane corresponds to the situation after the first closing of the container, as illustrated in FIG. 3.
STATE 3 = This state of the membrane corresponds to the situation after the first opening of the container and all subsequent openings, as illustrated in FIG. 4.
STATE 4 = This state of the membrane corresponds to the situation after the second closing of the container and all subsequent closings, as illustrated in FIG. 5.

Reading of the word (A, B, C) will thus give the possibility to check that the state of the cover corresponds to the expected state under the circumstances. More about reading and writing below.

As mentioned above the word {A, B, C} is also used to control the enabling/disabling of the different areas of the memory associated with the membrane. The following table gives an example of how the memory could be managed depending on the data word {A, B, C}.

TABLE 2

| L1 | L2 | {A, B, C} | STATE | Read/write modes |
|---|---|---|---|---|
| 0 | 1 | {0, 0, 0} | STATE 1 | Read and Write |
| 1 | 1 | {1, 0, 0} | STATE 2 | Read and part Write |
| 0 | 0 | {0, 0, 1} | STATE 3 | Read |
| 1 | 0 | {0, 1, 0} | STATE 4 | Read |

A membrane of the more sophisticated type described above constituting a transponder/sensor in which the electromechanical contacts thus senses the pressure applied to the membrane can be used in many interesting applications. The FIGS. 8–11 illustrate the different steps in a first embodiment of the invention of a method for protection of the distribution and use of a product against fraud. Such a method could for instance be used in an application for the control of the complete link between the producer of a disinfecting agent and the use of this agent in a public air conditioning systems e.g. in an underground metro station or the like.

Figure 8:
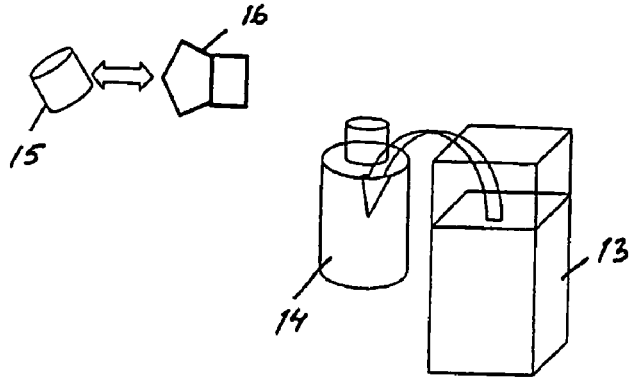
FIGS. 8–11 illustrate in a schematic form a first embodiment of the method according to the invention.

At the producer end, cf. FIG. 8, a product, e.g. a manufactured product, here exemplified as a liquid, is stored in a first container 13. It should be clear that the product could have any form and appearance. The authenticity of the product in that first container 13 is of course guaranteed by the producer.

Figure 11:
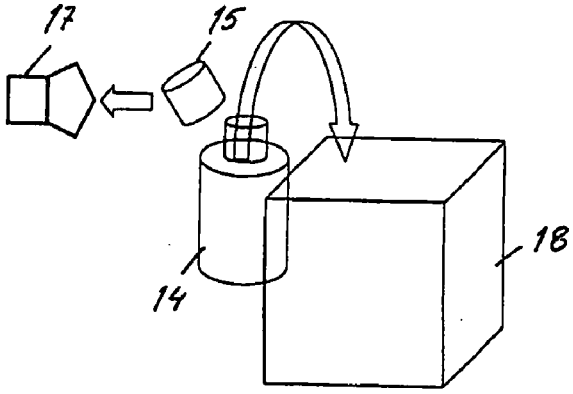

The technical problem now resides in safely distributing smaller quantities of this product by means of distribution containers 14 to end user or distributor sites, cf. FIG. 11, where the product for this illustration is filled into a second container 18. The filling up of the container 18 at the end user or distributor site will in this context represent any type of use of the product. For example it could according to the above represent refilling of a disinfecting agent into an automatic installation for disinfecting e.g. the air conditioning system of a metro station. It could easily be imagined what could happen if let say a toxic product by mistake or deliberately was introduced into such a system.

Thus, the end user wishes to have absolute security concerning the authenticity of the product he is going to use.

A cover for the distribution container 14 provided with a membrane as described above constituting a transponder/sensor or with corresponding functions integrated is designated 15. A transceiver 16 of known type can transfer energy by means of RF radiation to the transponder/sensor of the cover 15. The transceiver can also read data stored in the memory of the transponder/sensor and write data into the same. The data communication between the membrane and the transceiver is taking place on short distance and is typically encrypted for security reasons.

We assume that a producer of a certain product can be working with different producers of membranes. And different membranes could be used for different types of products and different types of containers. This means that the producer of the product needs data from the producer of the membrane in order to choose the correct membrane for the product. The membranes are therefore delivered to the manufacturer of the product with certain data already written into the memory of the same.

As described above, cf. especially FIG. 2 and tables 1 and 2, the data word {A, B. C} set by the initial positions of the contact devices, should be {0, 0, 0} corresponding to STATE 1 of the tables for an unused membrane. The transceiver is in the first step energising the transponder/sensor and reads the data word and checks that it corresponds to this expected value. Certain data from the producer of the membrane is also read, cf. FIG. 17.

If the read data correspond to expected values this is taken as evidence that the membrane including contact devices and transponder/sensor is in order. It also means that both the read and write functions for the transponder/sensor memory are enabled, cf. table 2.

If on the other hand there is something wrong with the data concerning the producer of the membrane, or the combination of the switch settings of the membrane is not indicating a virgin membrane then the process will be stopped.

If the process continues data is now written into specific locations of the transponder/sensor memory by means of the transceiver 16. The type of data could be product and producer identifications, time codes etc. in relation to the product in the container 13 to be filled into the distribution container 14. In this operation the transceiver could be co-operating with e.g. a PC or another connected I/O device (not shown) storing these data or enabling the input of these data by e.g. a keyboard.

After a possible proof reading step concerning all data now stored in the transponder/sensor of the cover, the write function is disabled for specific areas of the transponder/sensor memory. This could e.g. be done by means of a signal from the transceiver.

Product from the container 13 can now be filled into the distribution container 14 which is subsequently closed by means of the cover 15 including data according to the above.

Figure 9:
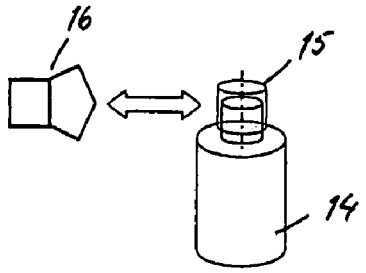

FIG. 9 illustrates in a schematic form a second step in a first embodiment of the method according to the invention.

A proof reading step can be carried out at this point. It is however not necessary. In a case where the product has a limited shelf life and the filled up containers are put in a stock before delivery it could on the other hand be of interest or even necessary to proof read the memory especially concerning the date codes and switch settings before shipping.

Figure 17:
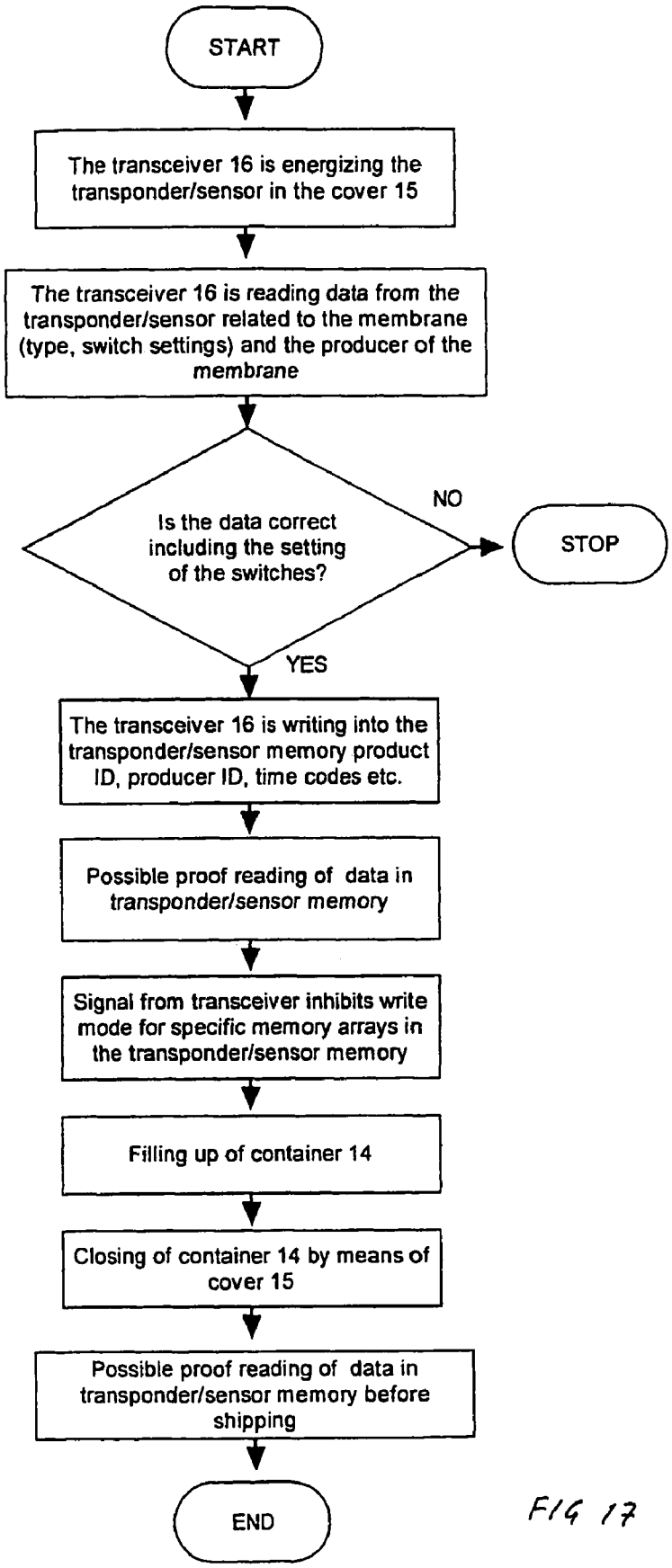
FIGS. 17–19 illustrate in the form of flow charts three variants of the steps of the method according to the invention carried out on the producer side.
Figure 18:
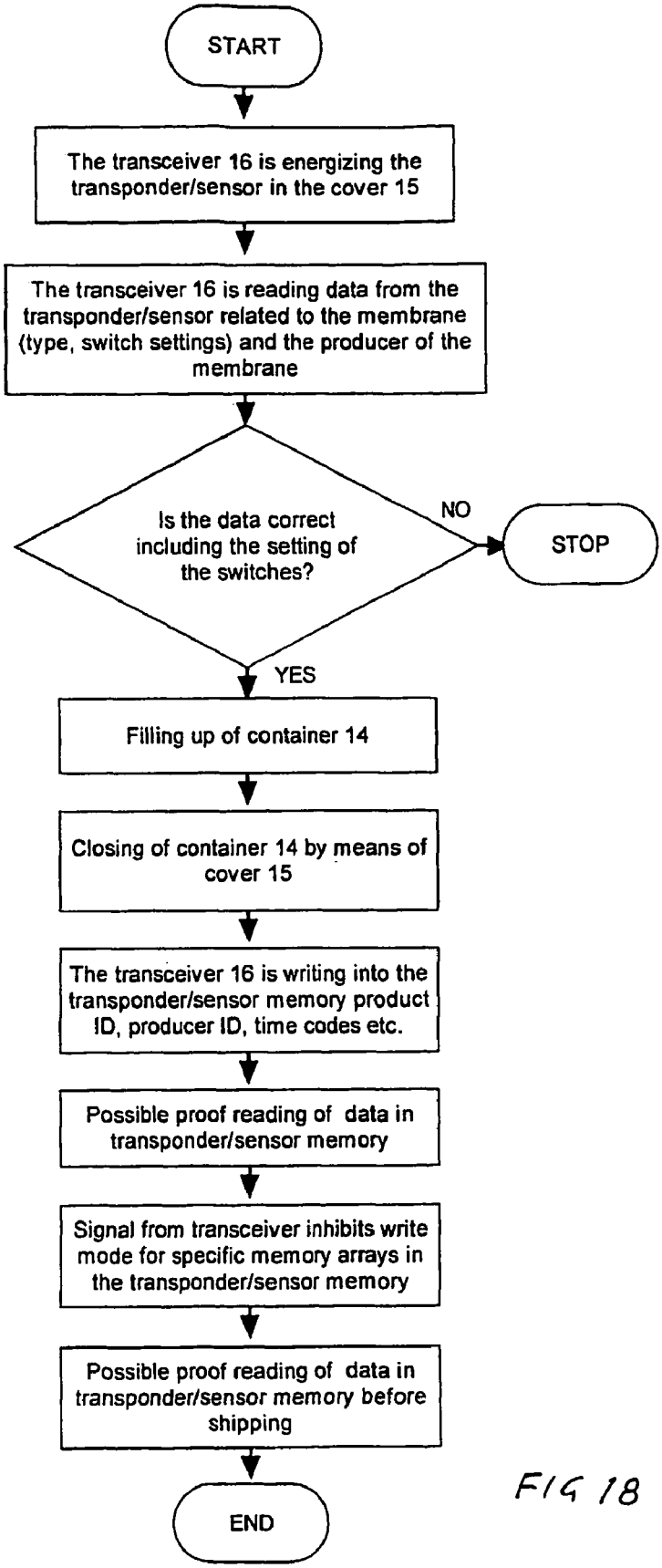
Figure 19:
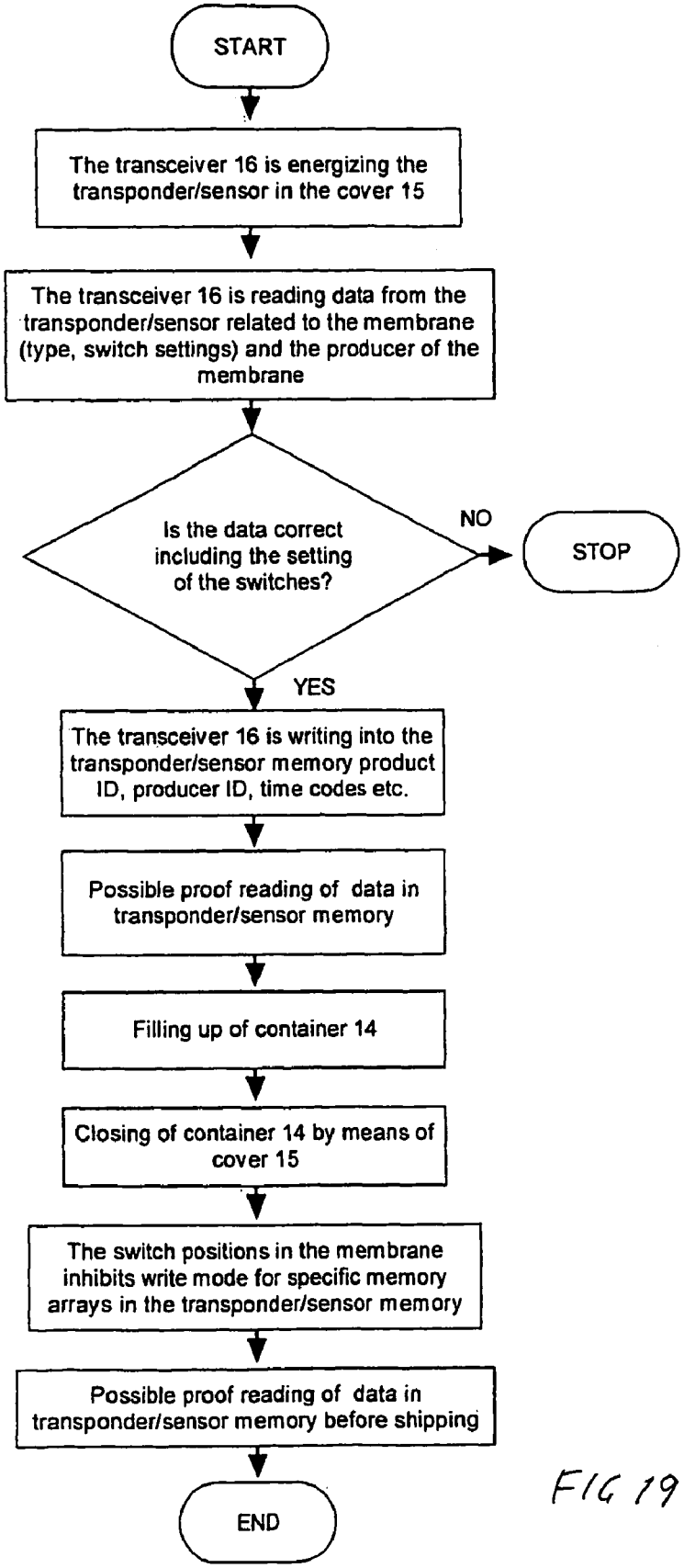

Cf. also FIGS. 17–19 and corresponding part of the specification.

Figure 10:
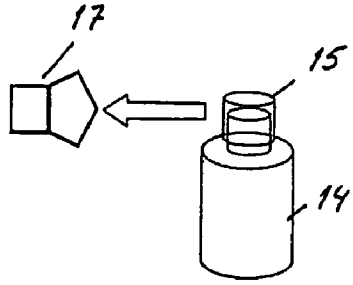

FIG. 10 illustrates in a schematic form a third step in a first embodiment of the method according to the invention.

The end user has now received the closed container and will present it to a transceiver 17 similar to the transceiver 16 at the producer side in order to read out producer data and cover status.

Figure 20:
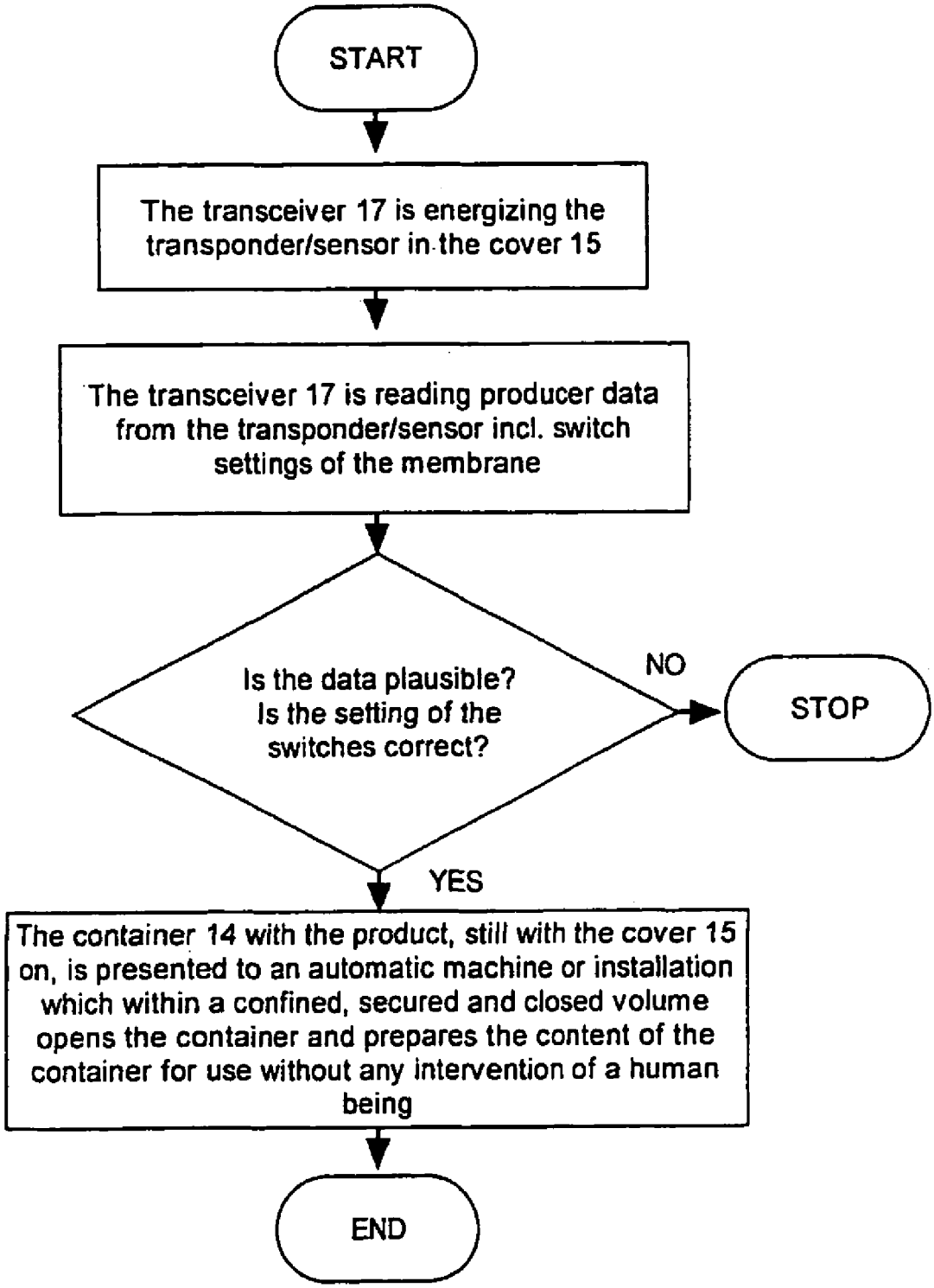
FIGS. 20–21 illustrate in the form of flow charts two variants of the steps of the method according to the invention carried out on the end-user side.
Figure 21:
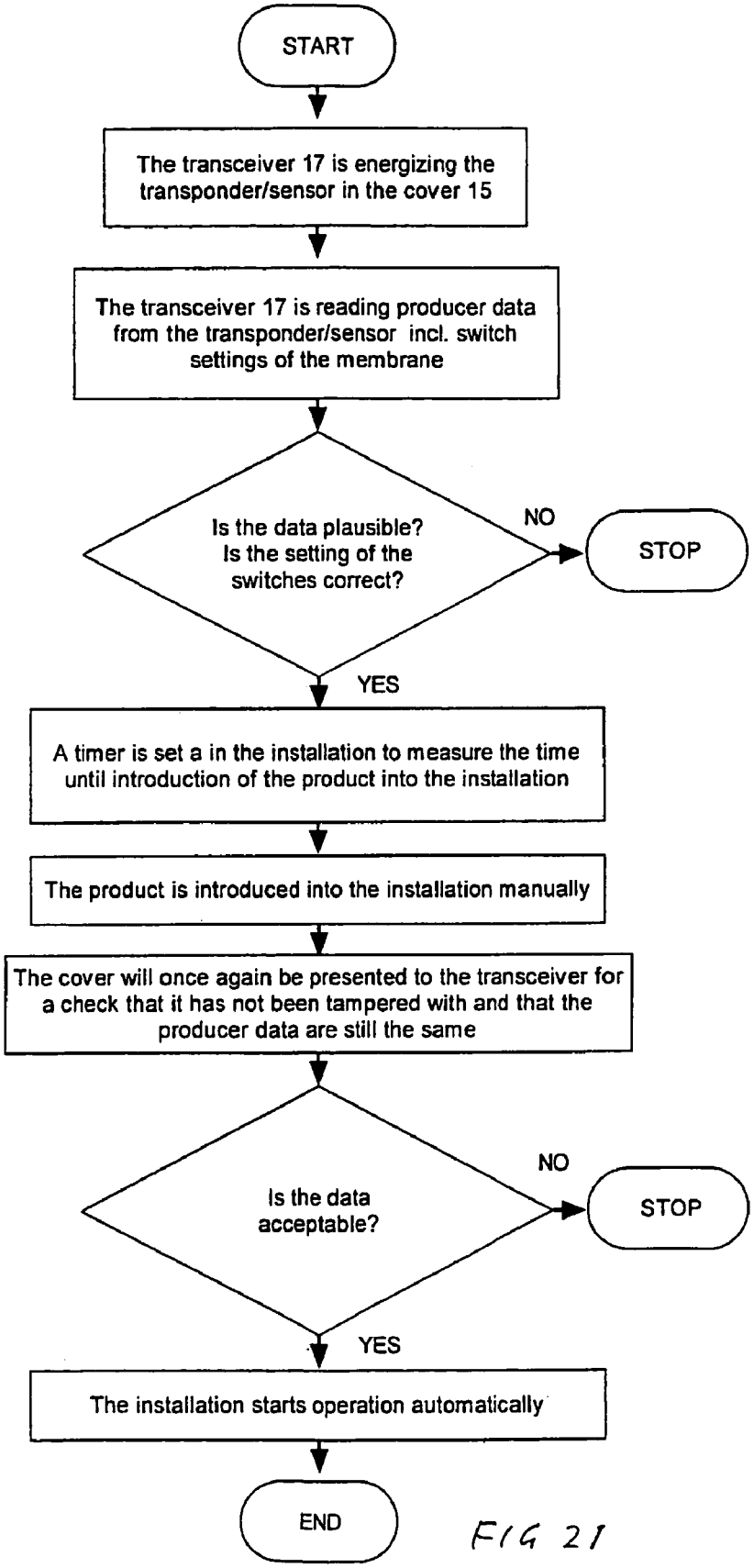

FIG. 11 illustrates in a schematic form a fourth step in a first embodiment of the method according to the invention. It shows the situation in which the product is going to be used. Cf. FIGS. 20–21 and the corresponding portion of the specification.

Figure 12:
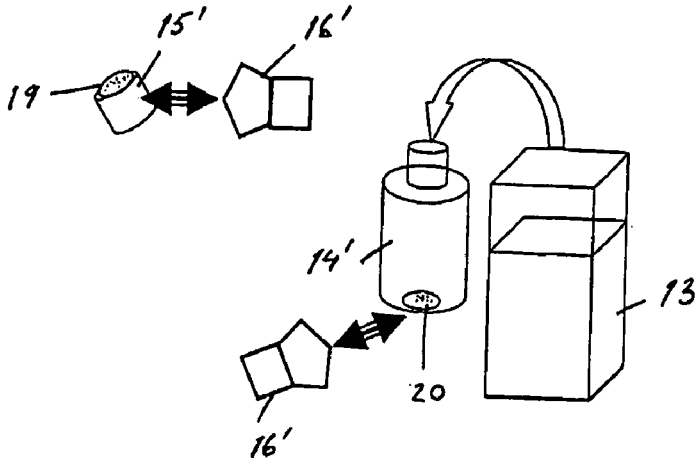
FIGS. 12–15 illustrate in a schematic form a second embodiment of the method according to the invention.
Figure 13:
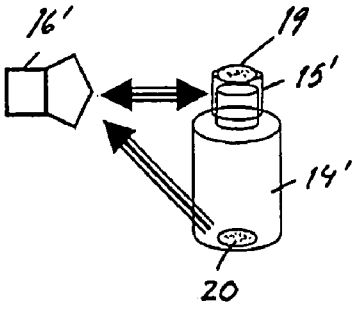
Figure 14:
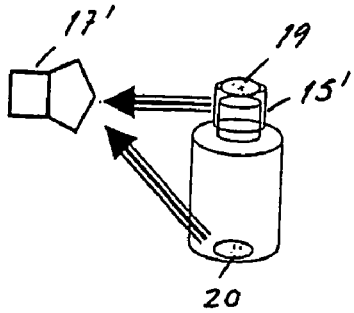
Figure 15:
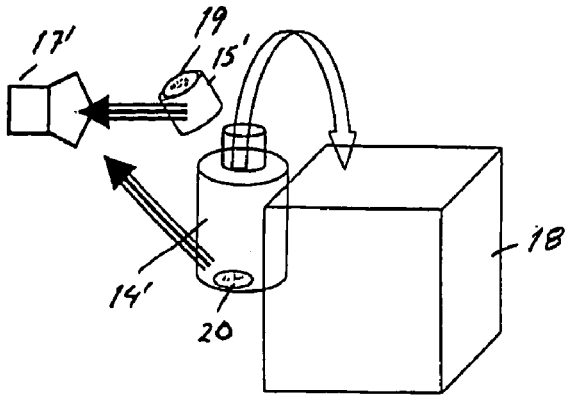
Figure 22:
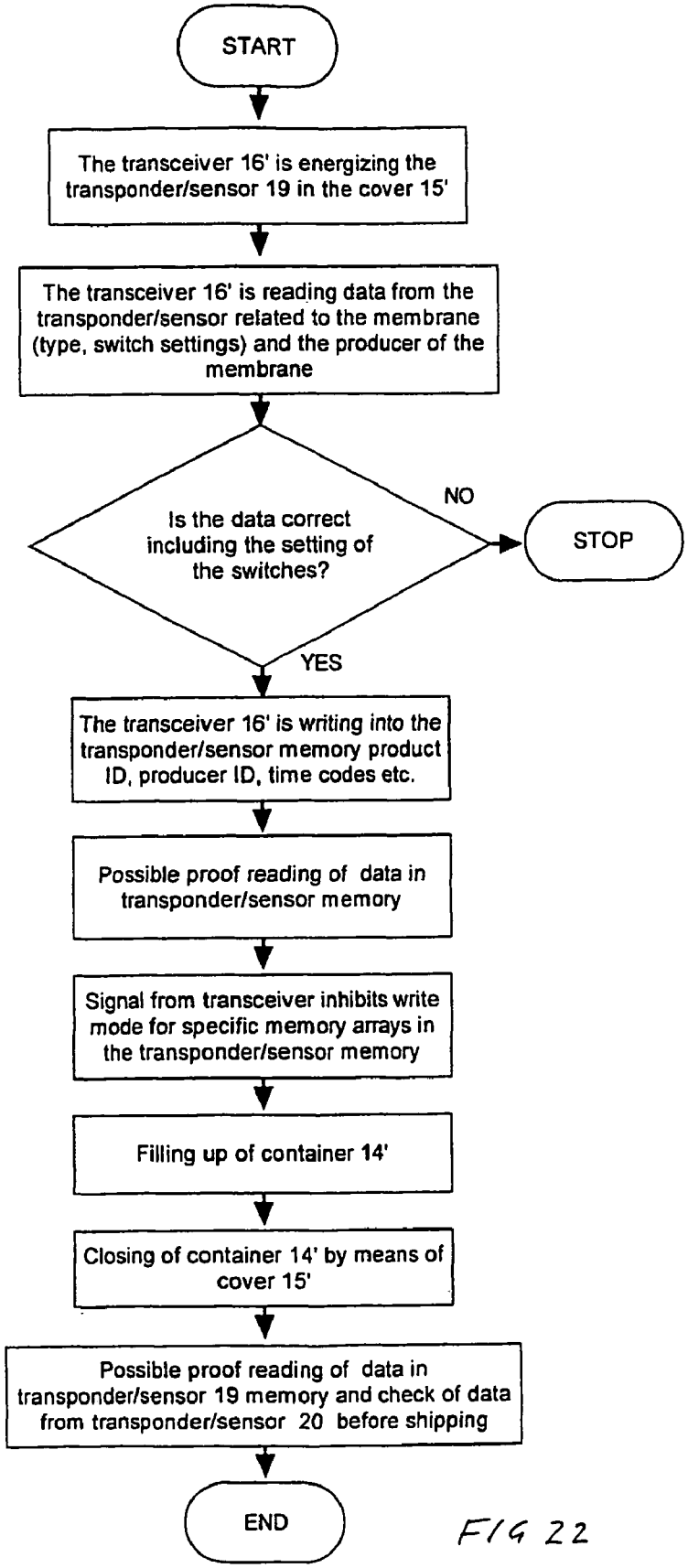
FIG. 22 illustrates in the form of a flow chart the steps of one embodiment of the method according to the invention carried out on the producer side.
Figure 23:
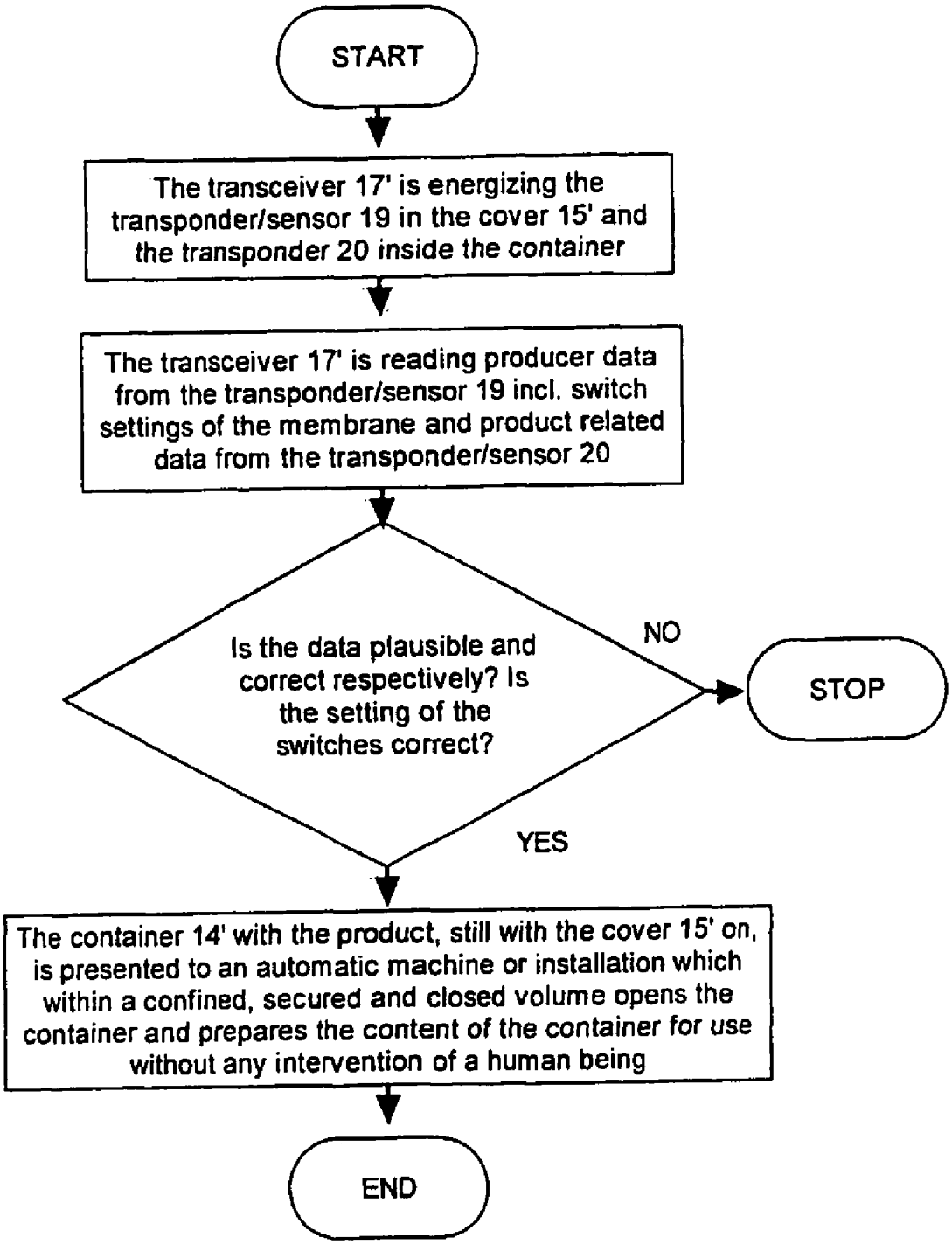
FIG. 23 illustrates in the form of a flow chart the steps of one embodiment of the method according to the invention carried out on the end-user side.

FIG. 12 illustrates in a schematic form a second embodiment of the method according to the invention, cf. also FIGS. 22–23 and the corresponding portion of the specification.

In the FIGS. 12 to 15 and FIGS. 22 and 23 is described a system in which the security has been increased by means of the addition of a transponder/sensor device 20 inside the container. In this case the product is typically a liquid. The sensor is able to measure one or several parameters related e.g. to the grade of alteration, e.g. deterioration, of the product. Alteration could for instance occur due to storage under unsuitable conditions. The device 20 thus comprises a sensor device connected to a transponder which could be interrogated from outside the container. In general the sensor is capable of measuring one or several parameters related to the contents of the container so that not only alteration of a given content could be detected but also e.g. the substitution of the contents. The device 20 could also be provided with a memory function so that changes in a parameter with time could be traced.

In relation to the procedure described in connection to the FIGS. 8 to 11 there will now be introduced a step of reading out actual product data from the container 14. Especially it will be possible to check stored containers before delivery for product alteration. On the end-user side it will be possible to check the contents at the delivery without opening the container. The installation which on the end-user side is going to make use of the product can with this embodiment of the method also increase the security.

As in the embodiment of the method according to FIGS. 8 to 11 the data communication between the transceiver 16' and the transponder/sensor 19 is preferably encrypted. It should be noted that the corresponding communication between the transceiver and the transponder/sensor 20 does not have to be encrypted. The use of the device 20 also gives the possibility to create a matched pair of container 14' and related cover 15'. The memory of the transponder/sensor 19 could thus include a cover identification code and the transponder/sensor 20 a corresponding container identification code which could be different. Both codes are read by means of the transceiver 16' at the producer side and a calculated checksum is created according to a given algorithm.

At the end-user side the two ID codes are again read by means of the transceiver 17' and the calculation is repeated. In this way it will be possible to detect if cover or container has been replaced during the transport from producer to end-user.

Figure 16:
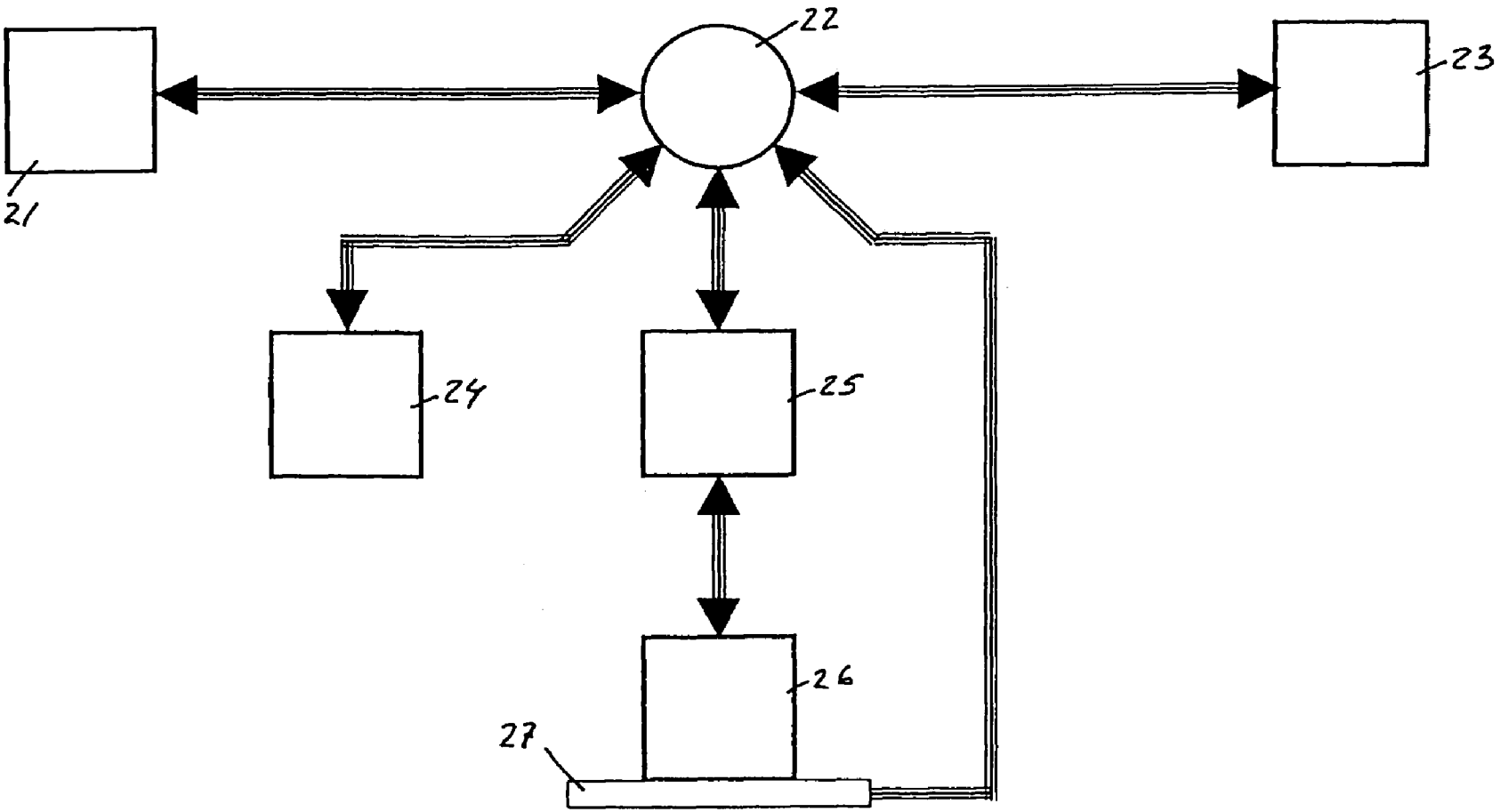
FIG. 16 shows in a schematic form the overall system implementation of a system making use of the method according to the invention.

FIG. 16 shows in a schematic form the overall implementation of a system making use of the method according to the invention in an application as exemplified above. The unit designated 21, a programming unit, or man-machine interface, used for system setup is connected to a controller 22. The unit 23 is a hardware installation e.g. an evaporator for a disinfecting system according to the example also connected to the controller 22. A unit 24 for identification of the operator is also illustrated. The equipment for writing and reading data and energising the transponders has been illustrated with the unit 25, The designation 26 stands for the container including the transponder/sensors. If suitable additional measurements can be carried out on the end user side, e.g. weighting of the container before authorisation to use. Necessary equipment for this purpose is illustrated with the unit 27.

FIGS. 17–19 illustrate in the form of flow charts three variants of the steps of the method according to the invention carried out on the producer side. Cf. also FIGS. 8 and 9 above. In the first variant, FIG. 17, when the data has been checked, the information such as product ID, producer ID, time codes etc. are entered into the memory of the membrane before the container is filled up and the cover is mounted on the container. In FIG. 18 the container is filled up and closed before the data is entered. In this variant data concerning e.g. the net weight of the product could also be entered which could be advantageous in certain applications.

Now, a signal from the transceiver could block the write mode for specific memory arrays in the transponder/sensor memory. In this way it is made sure that related data later on can not be manipulated. As an alternative the switch positions after the first closing of the container could generate the write inhibition, cf. FIG. 19.

FIGS. 20–21 illustrate in the form of flow charts two variants of the steps of the method according to the invention carried out on the end-user side. A transceiver 17 is reading data from the transponder/sensor. At first a verification of the plausibility of the data it reads is carried out. Data could for instance be checked against a local database to confirm that the producer is credible and that the product will suit the end-user's installation. Additionally the dataword representing the switch settings will be read out and checked. At this point the container could be stored temporarily on the end-user's side provided the test is passed.

If the test is passed the container 14 with the product could immediately or after some time, still with the cover 15 on, be presented to an automatic machine or installation which within a confined, secured and closed volume opens the container and prepares the content of the container for use without any intervention of a human being. In this case it is suitable that the machine has its own transceiver and again automatically reads out relevant data before any operation is started with the contents of the container.

As an alternative a human operator could set a timer in the installation once the test according to the above has been made. The idea is that the product should be entered into the installation within a certain time e.g. counted from the opening of the container. The product will be introduced into the installation. After that the cover will once again be presented to the transceiver for a check that it has not been tampered with and that the producer data are still the same. After that final check the installation will start operation.

The human operator could in order to increase the security be asked to identify himself by means of some known technique, e.g. electronic fingerprint test, eye measurements, voice recognition, etc. A common method is also to specify an imperative sequence of operation steps making it more difficult for an unauthorised person to operate the installation.

FIGS. 22–23 illustrate in the form of a flow chart the steps of one embodiment of the method according to the invention carried out on the producer side and the end-user side respectively, cf. also the specification above and the drawings 12 to 15.

FIG. 23 illustrates in the form of a flow chart the steps of one embodiment of the method according to the invention carried out on the end-user side.

What is claimed is:

1. A membrane (1) for a cover (15,15') for closing a container (14,14') having the general form of a cylinder with a soft surface structure and being compressible in the direction of the axis of the cylinder, characterised in that it comprises two mutually parallel, generally flat parts (2,3) arranged at the upper and lower part of the membrane (1) respectively, arranged to move axially in relation to each other guided in said movement by means of guiding means (4, 41,42, 43), resilient means (6,6') arranged to generate a counterforce between the flat parts (2,3) during compression of the membrane in the direction of the axis, at least a first and a second electrical contact device (G1, C1, C1') and (G2, C2, C2') operated by means of the axial movement between the circular parts (2,3), the combined electrical settings of which contact devices will carry information about the compressions and decompressions of the membrane, means for presenting said settings to the outside of the membrane.

2. A membrane according to claim 1, characterised in that said first electrical contact device (G1, C1, C1') is changing its electrical conductivity each time the membrane (1) is compressed and decompressed respectively, said second electrical contact device (G2, C2, C2') is changing its electrical conductivity only at the first decompression of the membrane (1).

3. A membrane according to claim 2, characterised in that said means for presenting said settings to the outside of the membrane (1) is of galvanic type.

4. A membrane according to claim 2, characterised in that said means for presenting said settings to the outside of the membrane (1) is of capacitive type.

5. A membrane according to claim 2, characterised in that said means for presenting said settings to the outside of the membrane comprises electronic circuits (E1, E2) connected to said contact devices (G1, C1, C1') and (G2, C2, C2') including an antenna with associated RF circuitry, control logic circuits and memory means, and in that the energy for the operation of these electronic circuits is transmitted from the outside of the membrane.

6. A membrane according to claim 1, characterised in that said means for presenting said settings to the outside of the membrane (1) is of galvanic type.

7. A membrane according to claim 1, characterised in that said means for presenting said settings to the outside of the membrane (1) is of capacitive type.

8. A membrane according to claim 1, characterised in that said means for presenting said settings to the outside of the membrane comprises electronic circuits (E1, E2) connected to said contact devices (G1, C1, C1') and (G2, C2, C2') including an antenna with associated RF circuitry, control logic circuits and memory means, and in that the energy for the operation of these electronic circuits is transmitted from the outside of the membrane.

9. A cover (15,15') for closing a container (14,14') comprising a membrane (1) having the general form of a cylinder with a soft surface structure and being compressible in the direction of the axis of the cylinder, characterised in that said membrane comprises two mutually parallel, generally flat parts (2,3) arranged at the upper and lower part of the membrane (1) respectively, arranged to move axially in relation to each other guided in said movement by means of guiding means (4,41, 42,43), resilient means (6,6') arranged to generate a counterforce between the flat parts (2,3) during compression of the membrane in the direction of the axis at the closing of said container, at least a first and a second electrical contact device (G1, C1, C1') and (G2, C2, C2') operated by means of the axial movement between the circular parts (2,3), the combined electrical settings of which contact devices will carry information about the compressions and decompressions of the membrane, means for presenting said settings to the outside of the cover.

10. A cover (15,15') for closing a container (14,14'), characterised in that it comprises two mutually parallel, generally flat parts (2,3) arranged perpendicular to the axis of said cover to move along said axis in relation to each other guided in said movement by means of guiding means (4,41, 42,43), resilient means (6,6') arranged to generate a counterforce between the flat parts (2,3) when said parts are approaching each other at the closing of said container, at least a first and a second electrical contact device (G1, C1, C1') and (G2, C2, C2') operated by means of the axial movement between the flat parts (2,3), the combined electrical settings of which contact devices will carry information about the opening and closing of said container (14,14'), means for presenting said settings to the outside of the cover (15, 15').

11. A method for protection of the distribution by means of a closed container (14) from a producer site to an end-user site and confirming authenticity of the product at the end-user site, providing at the producer site a container (14) for the transport of the product and a cover (15) for closing said container including a membrane (1) for said cover (15) having the general form of a cylinder with a soft surface structure and being compressible in the direction of the axis of the cylinder, said membrane comprising two mutually parallel, generally flat parts (2, 3) arranged at the upper and lower part of the membrane (1) respectively, arranged to move axially in relation to each other guided in said movement by means of guiding means (4,41, 42,43), resilient means (6,6') arranged to generate a counterforce between the flat parts (2,3) during compression of the membrane in the direction of the axis, at least a first and a second electrical contact device (G1, C1, C1') and (G2, C2, C2') operated by means of the axial movement between the circular parts (2,3), the combined electrical settings of which contact devices will carry information about the compressions and decompressions of the membrane, means for presenting said settings to the outside of the membrane, said method comprising the steps of filling up the container (14) with product, closing said container my means of said cover (15) and transporting said closed container to the end-user site at which the combined electrical settings of the contact devices is read to confirm authenticity of the product.

12. A method for protection of the distribution by means of a closed container (14) from a producer site to an end-user site and use at the end-user site of a product against fraud, providing at the producer site a container (14) for the transport of the product and a cover (15) for closing said container including a membrane (1) for said cover (15) having the general form of a cylinder with a soft surface structure and being compressible in the direction of the axis of the cylinder, said membrane comprising two mutually parallel, generally flat parts (2,3) arranged at the upper and lower part of the membrane (1) respectively, arranged to move axially in relation to each other guided in said movement by means of guiding means (4,41, 42,43), resilient means (6,6') arranged to generate a counterforce between the flat parts (2,3) during compression of the membrane in the direction of the axis, at least a first and a second electrical contact device (G1, C1, C1') and (G2, C2, C2') operated by means of the axial movement between the circular parts (2,3), the combined electrical settings of which contact devices will carry information about the compressions and decompressions of the membrane, means for presenting said settings to the outside of the membrane comprising electronic circuits (E1, E2) connected to said contact devices (G1, C1, C1') and (G2, C2, C2') including an antenna with associated RF circuitry, control logic circuits and memory means, constituting together with the contacts a transponder/sensor device, and further a first transceiver (16) which can be operated to transfer energy to said transponder for the operation of the same and to read and write data from and to said memory means, and providing at the end-user site a second transceiver (17) which can be operated to transfer energy to said transponder for the operation of the same and to read and write data from and to said memory means and an automatic installation for distribution of the product provided with a confined, secured and closable volume in which the container (14) could be entered, opened and the content prepared for use, said method comprising at the producer site the steps of said first transceiver (16) is operated to energise said transponder/sensor in the cover (15), said first transceiver (16) is operated to read out data from the transponder/sensor related to at least the switch settings of the membrane, said transceiver (16) is operated to decide whether or not said data is correct, and if correct, said transceiver (16) is operated to write into the transponder/sensor memory at least a product identification number and a producer identification number, whereafter a signal from said transceiver inhibits write mode for specific memory arrays in the transponder/sensor memory, the container (14) is filled up with product and closed my means of the cover (15) and is then transported to the end-user site at which said second transceiver (17) is operated to energise said transponder/sensor in the cover (15), said transceiver (17) is operated to read out data from the transponder/sensor related to the product, the producer and the switch settings of the membrane, said transceiver (17) is operated to decide whether or not said product and producer data is plausible and if said switch settings are correct, and if so, the container (14) with the product and the cover (15) still closed is presented to said automatic installation for distribution of the product which within said confined, secured and closed volume opens the container (14) and prepares the content for use.

* * * * *